US006052967A

United States Patent [19]

Hambach

[11] Patent Number: 6,052,967

[45] Date of Patent: Apr. 25, 2000

[54] APPARATUS FOR MARKING CLOSURE CLIPS

[75] Inventor: Hubert Hambach, Gedern, Germany

[73] Assignee: Poly-Clip System GmbH & Co. KG, Frankfurt am Main, Germany

[21] Appl. No.: 09/325,060

[22] Filed: Jun. 3, 1999

[30] Foreign Application Priority Data

Jun. 5, 1998 [DE] Germany ..... 198 25 106

[51] Int. Cl.[7] ..... B65B 61/26

[52] U.S. Cl. ..... 53/138.4; 53/131.3; 53/131.4

[58] Field of Search ..... 29/33.5, 243.56, 29/243.57; 53/131.2, 131.3, 131.4, 138.2, 138.3, 138.4

[56] References Cited

U.S. PATENT DOCUMENTS 4,182,015 1/1980 Niedecker .

4,458,402 7/1984 Evans et al. .

4,827,591 5/1989 Arnone .

*Primary Examiner*—Daniel B. Moon

*Attorney, Agent, or Firm*—Norris, McLaughlin & Marcus, P.A.

[57] ABSTRACT

There is disclosed an apparatus for marking closure clips (22) having a clip base (24) and clip legs (26, 28) adjoining the same on both sides, comprising a rod (20) for guiding the closure clips, an embossing stamp (50) movable relative to the rod for embossing the mark onto the closure clips supported by the rod, and comprising a flap-type crimping element having at least one crimping flap (12) for producing a packaging casing neck free from filling in a tubular or bag-shaped package to be closed with a closure clip (22). It is provided that the crimping flap (12) carries and drives the embossing stamp (50), and the embossing stamp is fixed at the crimping flap such that it marks a closure clip (22) when the crimping flap carrying the stamp is closed for producing the neck free from filling.

2 Claims, 3 Drawing Sheets

20
18
10
34
12
32
14
20
50
36
38
30
44
16
42

APPARATUS FOR MARKING CLOSURE CLIPS

This invention relates to an apparatus for marking closure clips having a clip base and clip legs adjoining the same on both sides, comprising a rod for guiding the closure clips, an embossing stamp movable relative to the rod for embossing the mark onto the closure clips supported by the rod, and comprising a flap-type crimping element having at least one crimping flap for producing a packaging casing neck free from filling in a bag-shaped or tubular package to be closed with a closure clip.

Closure clips as mentioned above are frequently used for closing tubular or bag-shaped packages. It is often desired that these closure clips carry marks which serve for instance to check batches. The marks may for instance consist of an individual sequence of numbers.

Such marks can already be embossed into the closure clips by the manufacturer of the closure clips. However, this has the disadvantage that it is already on placing the order that the buyer of the closure clips must know how many closure clips with the corresponding embossed mark he needs.

In DE-OS 41 20 440 it is described as particularly advantageous to apply an embossed or printed mark on clip blanks provided in the shape of rods; this is said to be easier than marking completely or preparatorily bent clip blanks; accordingly, this prior art provides a coding means for the clips before or in the bending station, which coding means acts on the still straight clip blanks, i.e. before the bending operation or during the same. In this prior art it is disadvantageous that when embossing while bending the closure clips from their stretched form to their U-shaped form only the clip base can be provided with an embossed mark, because only the clip base is supported during the bending operation. However, when the mark is applied before the bending operation starts, a not insignificant number of already marked closure clips must in general be removed manually from the closing means, when a change in product requires a change in mark.

There is also known the subsequently described method of marking closure clips during closure. For closing purposes, a closure clip is usually guided by a stamp such that first of all the casing of a package to be closed gets between the legs of the closure clip. Subsequently, the free ends of the closure clip legs come to lie on a die, by means of which the legs are bent around the bag neck. The embossing stamp for marking the closure clip is part of that stamp which guides the closure clip. The counterforce required for embossing is that force which is required for closing the closure clip between stamp and die. The direction of this counterforce is predetermined by the closing operation and extends in a plane defined by the clip legs transverse to the clip base. The mark must therefore be embossed into the clip base from the outside. This method involves the advantage that each closure clip can be marked individually during closure. It is, however, a disadvantage of this method that the embossing force depends on the counterforce when closing the closure clip. However, this counterforce depends on various circumstances such as the shape of the closure clip, the diameter of the bag neck, the sliding properties of the die, etc., and therefore is not constant. This results in unreliabilities during marking. A further disadvantage of the method consists in that the surface suitable for embossing on the outside of the clip base is very limited.

It is the object of the present invention to provide an alternative apparatus for marking closure clips, which largely overcomes the disadvantages of the known apparatuses and methods.

This object is solved by an apparatus as described above, where in accordance with the invention the crimping flap carries and drives the embossing stamp, and the embossing stamp is fixed at the crimping flap such that it marks a closure clip when the crimping flap carrying the stamp is closed for producing the neck free from filling.

There is preferred such an arrangement of crimping flap and embossing stamp that the embossed mark is each applied on one leg of a closure clip riding on the rod, and the counterforce required for embossing is exerted by the rod.

The invention will now be explained in detail by means of an embodiment with reference to the drawing, wherein.

Figure 1:
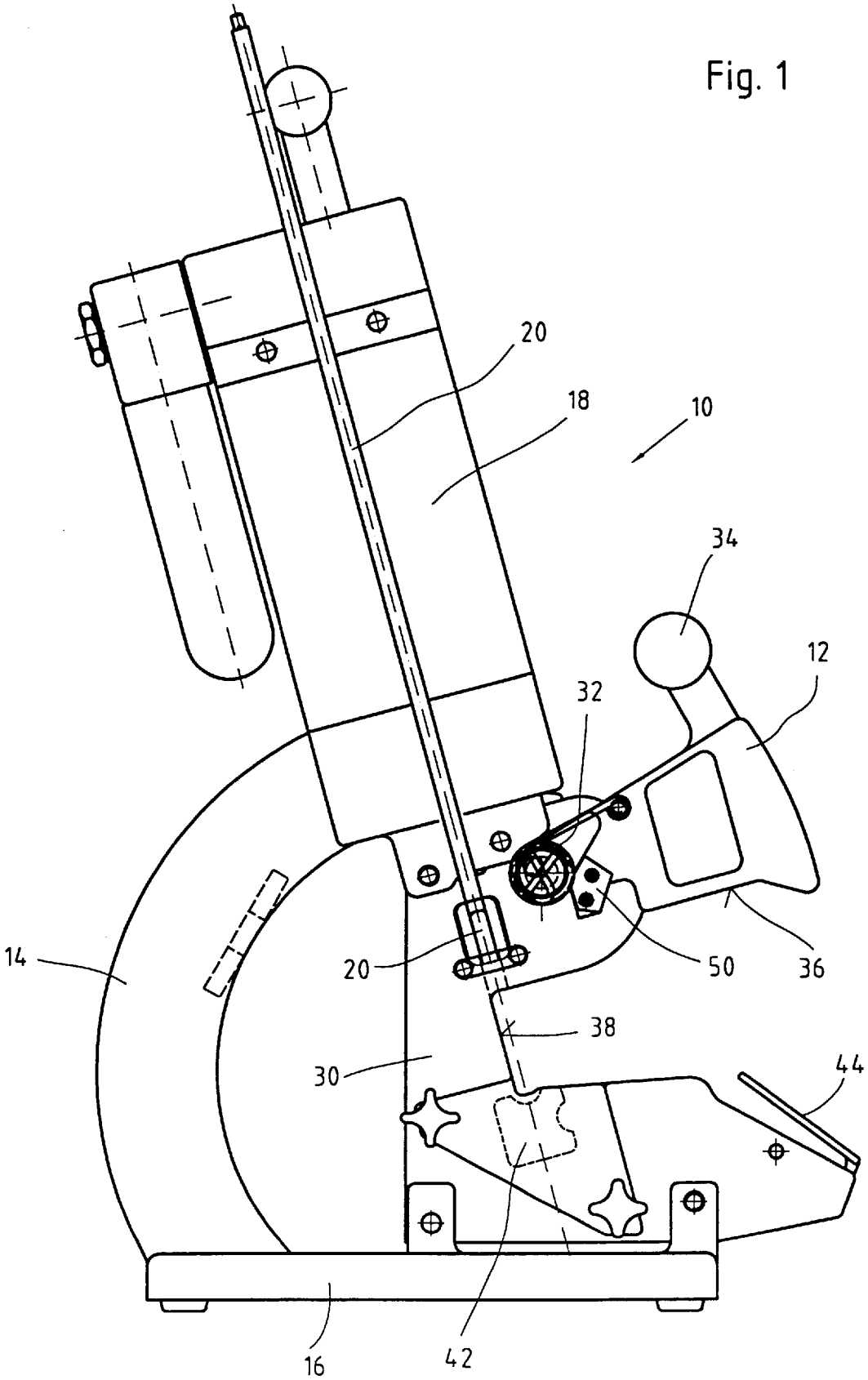
FIG. 1 shows a closing machine with a flap-type crimping element in the open condition.
Figure 2:
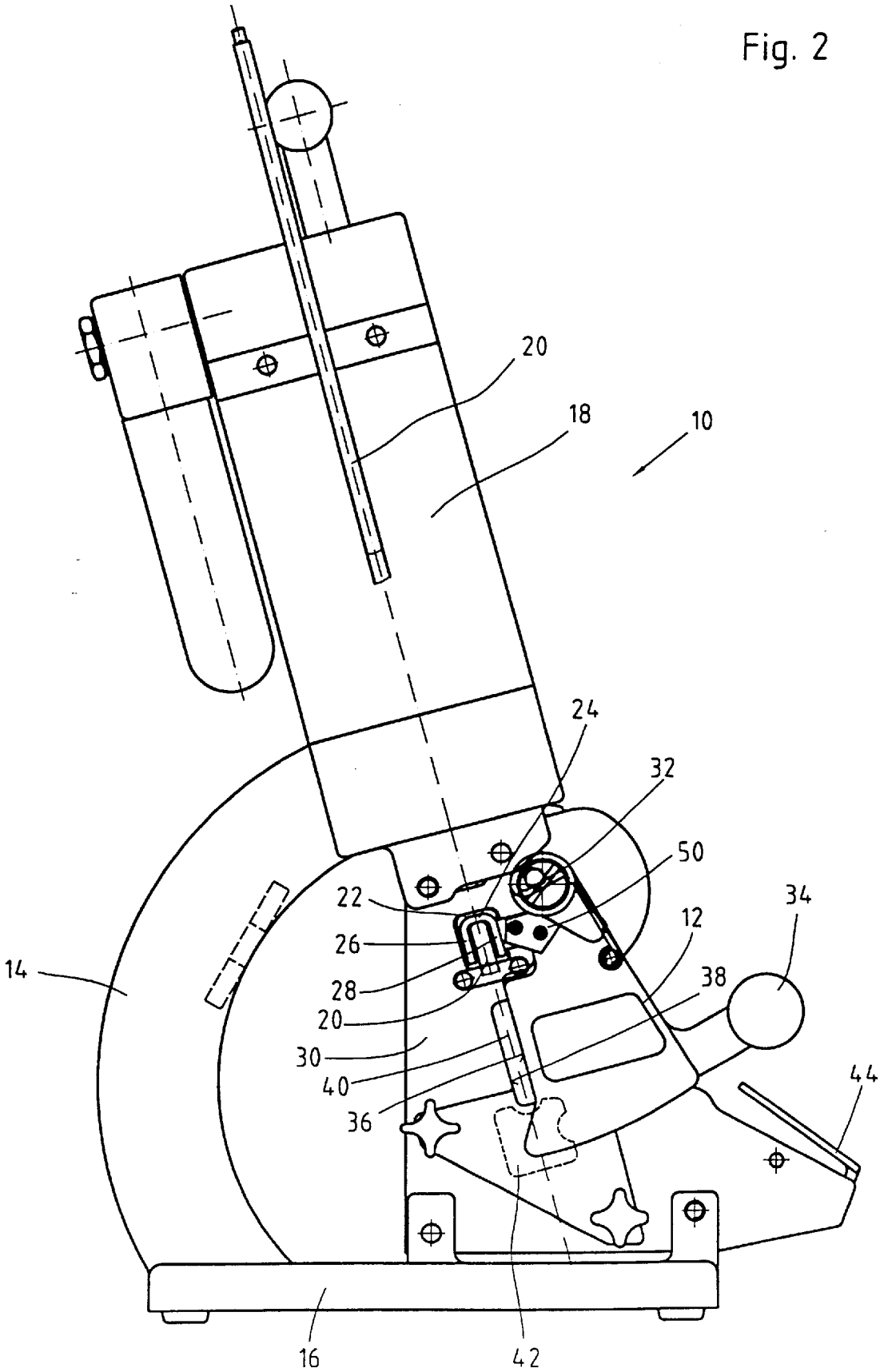
FIG. 2 shows the closing machine of FIG. 1 with the flap-type crimping element in the closed condition.

FIGS. 1 and 2 each show a closing machine 10 with a flap-type crimping element, whose crimping flap 12 is open in FIG. 1 and closed in FIG. 2. Further components of the closing machine 10 are a holder 14 with a base plate 16. The holder 14 carries a pneumatic cylinder 18 and a magazine rod 20, which serves to guide closure clips 22 (FIG. 2).

The pneumatic cylinder 18 drives a not represented stamp for closing the closure clips 22. Each closure clip 22 (see also FIG. 3) is formed by a clip base 24, to which a clip leg 26 and 28 is each adjoined on both sides. When the closure clip 22 is open, the two clip legs 26 and 28 extend parallel to each other.

The magazine rod 20 is formed by a flat bar which is slightly smaller than the distance between the two clip legs 26 and 28 when the closure clip 22 is open. In this way, the closure clips 22 can ride on the magazine rod 20 as it is illustrated in FIG. 2.

Between its base plate 16 and the pneumatic cylinder 18 the holder 14 carries a guide plate 30. At this guide plate 30, the crimping flap 12 is pivotally mounted by means of a swivel bearing 32. This provides for swivelling the crimping flap 12 from the open position represented in FIG. 1 into the closed position represented in FIG. 2. This is done by means of a handle 34 at the crimping flap 12. The crimping flap 12 has a squeeze edge 36, which is moved towards a counteredge 38 at the guide plate 30 when the crimping flap 12 is swivelled from the position represented in FIG. 1 into the position represented in FIG. 2. In the closed end position of the crimping flap 12, which is represented in FIG. 2, the squeeze edge 36 and the counteredge 38 lie opposite each other in parallel and between each other include a narrow opening 40. The narrow opening 40 and the path covered during closure by a closure clip held by the not represented stamp and driven by the pneumatic cylinder 18 are aligned with respect to each other such that when covering this path the two legs of the moving closure clips are guided along the opening 40 on both sides beside the same. The path covered by the closure clip ends where the free ends of its legs come to lie on a die 42, which is likewise fixed at the guide plate 30, and which bends the legs of the closure clips to the inside, in order to close the closure clip.

Closing a tubular or bag-shaped package by means of such a closing machine 10 is conventionally effected in that the filled package is placed against the counteredge 38. There upon, the crimping flap is closed, so that the package is squeezed flat between the squeeze edge 36 of the crimping flap and the counteredge 38 in the guide plate 30 to such an extent that no more filling is present at the squeezing point in the opening 40, but only packaging casing squeezed flat. Subsequently, a closure clip is moved along the above-described path by means of the not represented stamp and the pneumatic cylinder 18. The clip legs of the closure clips extend forwards in direction of movement and successively accommodate between each other the packaging casing squeezed in the opening 40 and in this way gather the packaging casing to form a neck. At the end of the path of movement the free ends of the clip legs come to lie on the die 42, which is shaped such that it diverts the free ends of the clip legs to the inside and in this way bends the clip legs to the inside, in order to bend them around the packaging casing neck. The packaging casing neck is thus closed with the closure clip.

Subsequently, the packaging casing neck can be cut through at the guide plate 30 by means of a cutting knife 44. This is particularly expedient when the neck of tubular packages was closed not by one, but simultaneously by two closure clips lying beside each other. Then, the packaging casing neck is cut through between the two closure clips. Closing machines setting only one or the two closure clips at the same time are known so far.

In contrast to known closing machines, the closing machine 10 has an embossing stamp 50 which is fixed at the crimping flap 12 in the vicinity of the swivel bearing 32 such that the embossing surface 52 of the embossing stamp 50 extends approximately parallel to the squeeze edge 36 of the crimping flap 12. Moreover, the embossing stamp 50 is aligned such that during the closure of the crimping flap 12 an embossing surface 52 comes to lie on a clip leg of the closure clip 22, which is still guided by the magazine rod 20. This clip leg undergoes embossing when the crimping flap 12 is closed. The magazine rod 20 acts as abutment and provides the counter-force required during embossing for holding the closure clip 22. The lever arm from the swivel bearing 32 to the embossing surface 52 is very short as compared to the lever arm between swivel bearing 32 and handle 34, so that the force required for embossing can easily by applied manually via the handle 34. By means of the closing device 34 it is thus possible to provide a closure clip with an embossed mark during each closure of the crimping flap 12. For closing several packages one after the other by means of the closing device 10, these packages need merely be inserted into the closing device 10, and subsequently the crimping flap 12 is closed. As a result, a closure clip is embossed. After closing the crimping flap, setting and closing a closure clip is triggered by means of the pneumatic cylinder 18. The crimping flap can then be opened again, on the magazine rod 20 a closure clip moves on to the place of the one just used, so that at the embossing position on the magazine rod there is likewise present a new, still unembossed closure clip. The same is embossed during the next closure of the crimping flap 12 and thereupon likewise moves on, in order to soon be used for closing a packaging casing.

Figure 3:
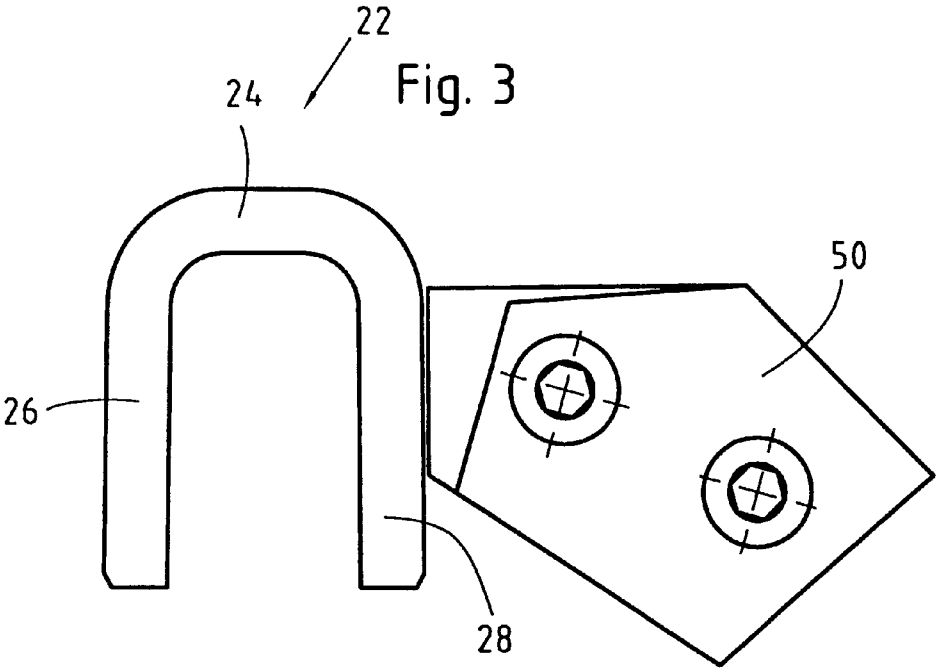
FIG. 3 shows the embossing stamp and the closure clip of FIG. 2 in a detailed view.

FIG. 3 illustrates in detail the closure clip 22 and the embossing stamp 50 of FIG. 2. To simplify matters, the magazine rod 20, which carries the closure clip 22, as well as the crimping flap 12, at which the embossing stamp 50 is fixed, are not represented in this Figure. It can be seen how the embossing surface 52 of the stamp 50 is pressed onto the clip leg 28 of the closure clip 22, in order to mark the same by embossing.

Figure 5:
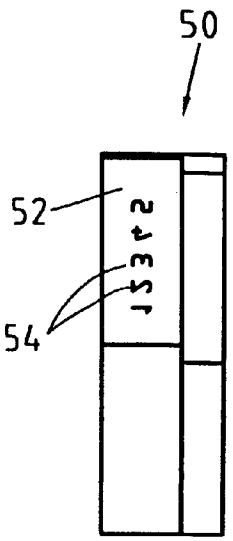
FIG. 5 shows the embossing stamp of FIG. 3 in a side view.
Figure 4:
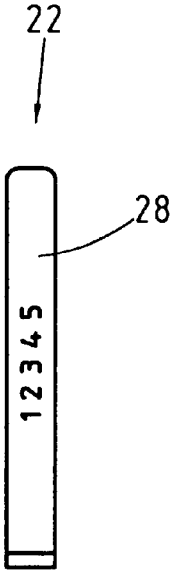
FIG. 4 shows the closure clip of FIG. 3 in a side view.

FIG. 4 shows the embossed clip leg 28 from the side, and FIG. 5 is a top view of the embossing surface 52 of the embossing stamp 50. The numbers 54 to be embossed protrude from the embossing surface 52 laterally reversed.

Figure 6:
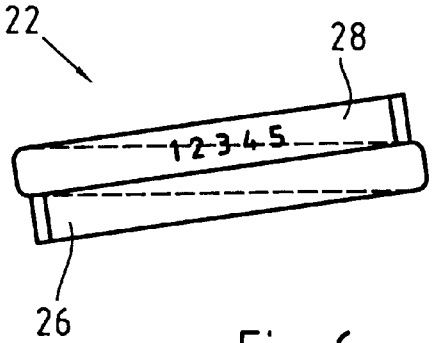
FIG. 6 shows the closure clip of FIGS. 3 and 4 after it has been closed.

FIG. 6 finally shows the closure clip 22 after it has been closed. The clip legs 26 and 28 have been bent to the inside and laterally rest against each other. The embossed mark in the clip leg 28 points to the outside and can clearly be seen.

I claim:

1. An apparatus for marking closure clips (22) having a clip base (24) and clip legs (26, 28) adjoining the same on both sides, comprising a rod (20) for guiding the closure clips, an embossing stamp (50) movable relative to the rod for embossing a mark onto the closure clips supported by the rod, and comprising a flap-type crimping element having at least one crimping flap (12) for producing a packaging casing neck free from filling in a tubular or bag-shaped package to be closed with a closure clip (22), wherein the crimping flap (12) carries and drives the embossing stamp (50), and the embossing stamp is fixed at the crimping flap such that it marks a closure clip (22) when the crimping flap carrying the stamp is closed for producing the neck free from filling.

2. The apparatus of claim 1, wherein the crimping flap (12) and embossing stamp (50) are arranged such that the embossed mark is applied onto a leg of a closure clip (22) riding on rod (20), and the counterforce required for said embossing is exerted by the rod (20).

* * * * *